US005544679A

United States Patent [19]

Tacq

[11] Patent Number: 5,544,679

[45] Date of Patent: Aug. 13, 1996

[54] DEFECTIVE WEFT YARN INSERTION PREVENTION

[75] Inventor: Jo Tacq, Ypres, Belgium

[73] Assignee: Picanol N.V., Ypres, Belgium

[21] Appl. No.: 348,868

[22] Filed: Nov. 29, 1994

[30] Foreign Application Priority Data

Dec. 1, 1993 [BE] Belgium ..... 9301329

[51] Int. Cl.[6] ..... D03D 47/34

[52] U.S. Cl. ..... 139/450; 139/116.2; 139/302; 139/453

[58] Field of Search ..... 139/450, 302, 139/116.2, 453

[56] References Cited

U.S. PATENT DOCUMENTS

| | | | |
|---|---|---|---|
| 3,621,885 | 11/1971 | Egloff | 139/122 |
| 4,185,667 | 1/1980 | Kendrick | 139/302 |
| 4,917,153 | 4/1990 | Mori et al. | 139/450 |
| 4,926,911 | 5/1990 | Shaw | 139/450 |
| 4,964,442 | 10/1990 | Tacq et al. | 139/452 |
| 4,998,567 | 3/1991 | Shaw | 139/116.2 |
| 5,123,455 | 6/1992 | Maina | 139/450 X |
| 5,137,059 | 8/1992 | Baeck et al. | 139/452 |
| 5,332,007 | 7/1994 | Wahhoud | 139/450 |
| 5,406,980 | 4/1995 | Oda et al. | 139/450 X |

FOREIGN PATENT DOCUMENTS

| | | |
|---|---|---|
| 0195469 | 3/1989 | European Pat. Off. . |
| 0454199 | 10/1991 | European Pat. Off. . |
| 4209686 | 9/1993 | Germany . |

*Primary Examiner*—Andy Falik
*Attorney, Agent, or Firm*—Bacon & Thomas

[57] ABSTRACT

A feed mechanism for several weft yarns, each with its own feed device capable of selecting the weft yarn to be inserted, includes sensors for monitoring the weft yarns for quality defects and for, upon detection a defect in a weft yarn, precluding the weft yarn from being selected for insertion until the portion of the weft yarn with the defect has been shunted into a region from where it can no longer be woven into the fabric.

18 Claims, 2 Drawing Sheets

DEFECTIVE WEFT YARN INSERTION PREVENTION

BACKGROUND OF THE INVENTION

1. Field of the Invention

The invention concerns a method for feeding and inserting weft yarns in a loom which includes a feed mechanism arranged to alternately feed at least two weft yarns supplied from at least two individual weft yarn feed devices, each feed device including a supply of yarn and means for selecting a weft yarn to be inserted into the fabric, the devices being driven by a control unit. The invention further concerns a feed mechanism to carry out the method.

2. Background of the Invention

Looms, and in particular gripper looms, are known in which the feed mechanism consists of a plurality of individual weft yarn feed devices each supplying the same type of weft yarn during consecutive insertions, the wefts being inserted by insertion means, for instance grippers, into a shed. The respective weft yarns from the individual feed devices remain joined to the lateral fabric edge between consecutive insertions, and are severed from the lateral fabric edge by insertion scissors at the beginning of the next weft insertion from the respective feed device. The junction to the lateral fabric edge is located in the vicinity of the first warp and, if the weaving includes a waste selvage, the junction is within the zone of the first waste warp yarn. In the event that the weaving excludes a waste selvage, the junction site is located in the vicinity of the lateral fabric edge. Insertion scissors for severing a weft yarn from its junction site at the beginning of the weft's insertion are known, for example from U.S. Pat. No. 3,621,885 or 4,964,442.

The known feed mechanism includes means to select the particular weft to be inserted by one of the insertion devices, the selection means being a yarn-presenting device in the case of a gripper loom which presents the particular weft to be inserted to the gripper, and one or more stop-motion devices to seize a ruptured weft. Each of the feed devices is equipped as a rule with a yarn supply made up of two bobbins, the end of the bobbin in use being connected to the beginning of a reserve bobbin. Typically, the feed mechanism also includes an accumulator unit between the weft yarn supplies and the presenting device. When weaving certain fabrics, for instance those for airbags or filters, the weft segments introduced into the fabric must be free of knots or other irregularities. When weaving this type of fabric, it is known to stop the loom using the stop motion upon detecting a knot or irregularity, such as occurs at the connection between bobbins, and to remove the weft with the irregularity. A danger is thereby incurred that during the ensuing startup, a so-called start-up strip will be created in the fabric, which is caused foremost by the wefts inserted immediately after startup not being beaten-up properly. Such start-up strips are especially undesirable in this type of airbag or filter fabric.

SUMMARY OF THE INVENTION

The object of the present invention is to provide a method of alternately feeding wefts to an insertion device from multiple individual weft yarn supplies which precludes weaving a weft with a defect such as a knot or other irregularity into the fabric so that the loom can keep on running using the remaining defect-free yarn supplies.

This object is achieved by monitoring the wefts for quality defects in the region between the yarn supply and the fabric, by transmitting quality-defect signals to the weft yarn feed-device control unit and analyzing the signals, and by causing the selection means to exclude the weft yarn with the defect from its selection operation until the defect arrives in a predetermined zone.

This method makes it possible for the feed mechanism to automatically preclude a defective weft, for instance one with a knot, from being woven into the fabric. Since the selection of a defective weft is prevented, the loom is able to keep on operating with the remaining feed devices and their wefts, and, as a rule, the loom will not need to be shut down and then restarted. The defective portion of the weft is shunted past the zone at which it would have been inserted into the fabric during a subsequent weft insertion, and thus will not be woven into the fabric. Consequently, the operating personnel will in general not need to intervene in the manufacture to obtain a fabric free of knots or other irregularities.

In one preferred embodiment of the method of the invention, the defective portion of the weft yarn remains joined to the fabric and is carried past the point where it would normally be inserted by the advancing fabric until the defective portion of the weft yarn has reached the vicinity of the fabric. Thereupon, this weft yarn may again participate in weft insertion because the defective portion of the weft yarn does not pass into the fabric.

In a second embodiment of the invention, instead of just being carried by the advancing fabric, the defective portion of the weft yarn is received by an additional device and shunted away. This design makes it possible to rapidly remove the defective portion of the weft yarn and thereby more rapidly resume normal operation of the feed device upon detecting a quality defect.

In a further embodiment of the invention, the feed mechanism comprises at least one detector for monitoring the weft yarns for defects, the detector being located in the vicinity of each feed device between the yarn supply and the fabric, and connected to the control unit which, upon receiving a signal indicating a weft defect, blocks the selection means from selecting the weft yarn containing the defect for insertion until the defective portion of the weft yarn has been shunted into a predetermined region.

In yet another embodiment of the invention, a detector is mounted in the region of the yarn supply of each guide device between two supply bobbins and emits a signal indicating a changeover from one supply bobbin to the other. This detector indirectly monitors the quality of the weft by assuming that defects are limited to the yarn connections between the bobbins of each weft supply, which is the case when the supply bobbins themselves are of high quality, with previous processing, especially respooling on a spooler, having assured that the yarns wound on .these bobbins are defect-free except for the knots necessary to connect the yarns of different bobbins.

In yet a further embodiment of the invention, the feed devices each include an accumulator device and each weft defect detector is mounted between the yarn supply and the accumulator device. This detector configuration is preferred when the supply bobbins may contain defective yarns, for instance with knots or out-of-tolerance thicknesses. In such a case, weft monitoring is preferably continuous and therefore such bobbins also can be processed with assurance that defective wefts will not be woven into the fabric.

DETAILED DESCRIPTION OF THE PREFERRED EMBODIMENTS

Figure 1:
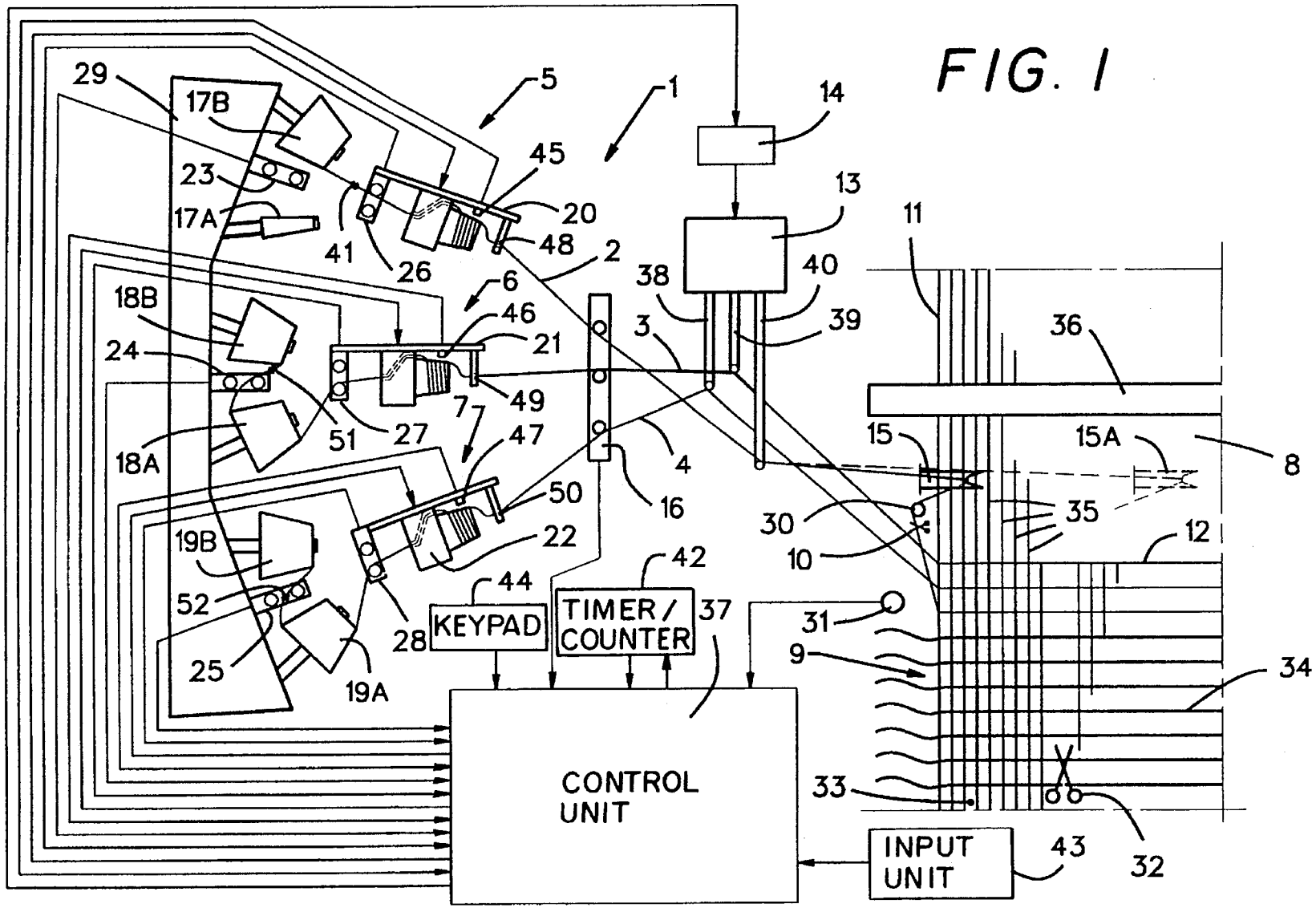
FIG. 1 is a cutaway view of a gripper loom equipped with a feed mechanism according to a preferred embodiment of the invention.
Figure 3:
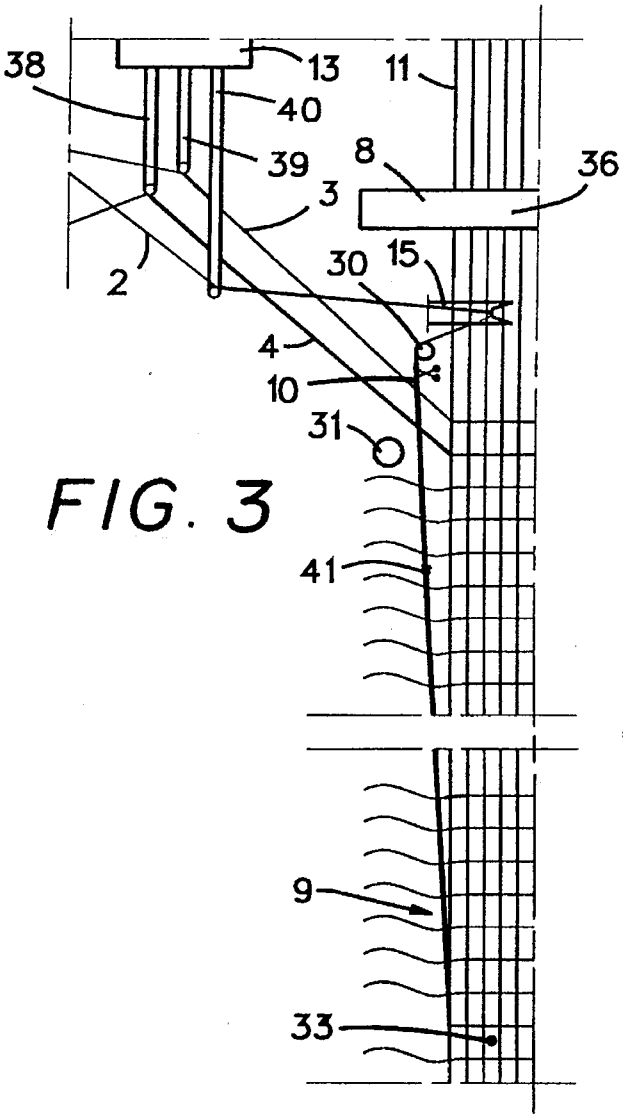
FIG. 3 is a cutaway view of a gripper loom similar to that of FIG. 2, after the portion of the weft yarn containing the defect has been shunted sufficiently far that weft insertion using the same weft yarn can be resumed.
Figure 2:
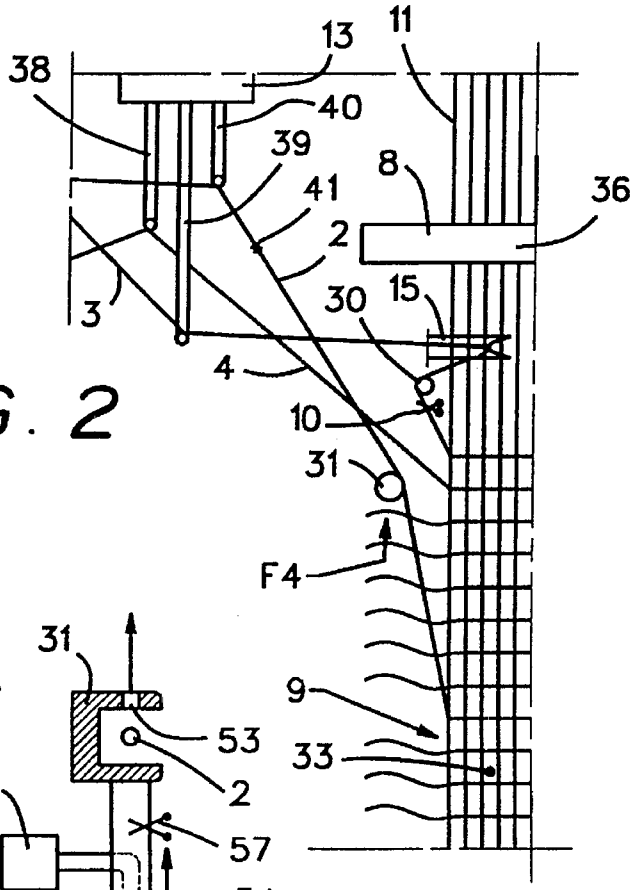
FIG. 2 is a cutaway view of the gripper loom of FIG. 1 following detection of a quality defect in a weft yarn and during the further operation using the remaining, defect-free wefts yarn.

The gripper loom shown in FIGS. 1 through 3 includes a feed mechanism 1 for three weft yarns 2, 3, 4, each fitted with its own feed device 5, 6, 7 used for the consecutive insertions of the same kind of weft yarn into a shed 8. Following insertion, the inserted weft remains joined at a site 9 to the fabric from which it will be severed only at the beginning of the next insertion of that particular yarn (following insertion of the other two yarns) by a scissors 10 illustratively driven by the loom drive. In the illustrated embodiment, the junction site 9 is located in the vicinity of the first warp facing the feed mechanism 1 and in the vicinity of the first warp 11 of a waste strip. In the event that the weaving takes place in the absence of a waste strip, the junction site will be in the vicinity of the lateral fabric edge. The insertion scissors 10 is mounted in the vicinity of the junction site 9 near the beat-up edge 12 and serves there to sever the weft yarn at the beginning of an insertion.

The feed mechanism 1 also includes selection units 14 with a yarn-presentation unit 13 made up of eyelet-fitted presentation needles 38, 39, 40. The selection unit 14 causes the weft yarn from a particular feed device 5, 6, 7 to be presented to a gripper 15. In addition, the feed unit 1 includes a stop-motion device 16 for sensing a rupture in the yarns 2, 3, 4. Each feed device 5, 6, 7 contains two supply bobbins 17A, 17B, 18A and 18B, 19A, 19B which together serve as the yarn supply, the end of the weft yarns on respective bobbins 17A, 18A, 19A being linked for instance by a knot 41, 51, 52 to the beginning of the weft yarns on bobbins 17B, 18B, 19B in the reserve position. Furthermore, each feed device 5, 6, 7 contains an accumulator unit 20, 21, 22. Detectors 23, 24, 25 are mounted between the supply bobbins and verify changeover from one bobbin to the other. A weft yarn guide 26, 27, 28 is also mounted in front of each of the respective accumulator units 20, 21, 22.

The bobbins 17A, 17B, 18A, 18B, 19A, 19B are mounted in stationary manner on a bobbin base 29, and accumulator units 20, 21, 22 are also affixed to this bobbin base. A guide 30 is present between the fabric beat-up edge 12 and the path of the gripper 15 and serves to stretch the particular weft yarn to be inserted, illustrated as weft yarn 2 in FIG. 1, between the junction site 9 and the gripper 15 before the weft yarn is cut off by the severing scissors 10. A guide 31 is also present in the vicinity of the junction site 9.

FIG. 1 also shows scissors 32 for severing the waste strip 33 from the fabric 34. The wefts should be woven as firmly as possible between the warps 35 of the waste strip 33. If thermoplastic wefts are being woven, the scissors 32 may be a melting device, thereby advantageously fusing the severed fillings with the warps 35 of the waste strip 33, as a result of which a very strong bond is achieved. FIG. 1 further shows a reed 36 and a gripper in a position 15A in the shed 8, inserting weft yarn 2 from the feed devices 5 into the shed 8.

The gripper loom includes a control unit 37 which controls, in a known manner, accumulator units 20, 21, 22 and selection means 14, selection means 14 in turn controlling yarn-presentation device 13 in such a way that the yarn-presentation needles 38, 39, 40 are advanced alternatingly so that the weft yarns 2, 3, 4 associated with the needles arrive in the region of the drive gripper 15, which then inserts the respective weft yarns into the shed 8. Detectors are connected to the control unit 37 and monitor the weft yarns 2, 3, 4 for quality defects, and in particular for knots. In the embodiment shown, the detectors are in the form of bobbin changeover detectors 23, 24, 25 which detect a changeover from one supply bobbin to the other and emit a signal in respect thereto. Such bobbin changeover detectors are known for instance from U.S. Pat. No. 5,137,059, and are adequate as indirect sensors of knots or irregularities in cases where the only knots are found in the yarn connections between the two supply bobbins, the bobbins themselves being free of any additional knots. This will be the case, in general, for bobbins used for knot-free fabrics.

Alternatively, in another preferred embodiment, yarn-thickness sensors may be used as the yarn-defect monitoring sensors. Such sensors are known and illustratively include optical transceiving elements which emit a signal when a knot or another irregularity passes through the sensor. These sensors may be mounted in the vicinity of the yarn guides 26, 27, 28, or the yarn guides 26, 27, 28 themselves which are in front of the accumulators 20, 21, 22 of the feed devices 5, 6, 7 may be used as sensors, as illustrated. Such yarn-thickness sensors are conventionally used when knots or irregularities are present within the weft yarn bobbins that must be precluded from being woven into the fabric.

The detectors 23, 24, 25 and/or 26, 27, 28 are configured in such a manner that the weft length between them and the fabric junction site 9 is larger than one weft insertion-length, that is, larger than the fabric width plus any waste strips and projecting ends. As a result, weft quality defects such as knots or the like can be detected before a weft segment is inserted into the shed 8. Because a weft is always present on the accumulators 20, 21, 22, an adequate length always is available when the detectors are mounted in front (upstream) of the accumulator device.

The control unit 37 responds to a quality defect indicated by a weft-defect signal by controlling the weft insertion selection means 14 to prevent a defective weft from being inserted. In the situation shown in FIG. 1, for example, the bobbin 17A has been used up, and as a result the weft yarn 2 with a knot 41 has been pulled through the bobbin changeover detector 23, which then sends a signal to the control unit 37. The signal is triggered as the accumulator 20 completes drawing the weft yarn 2 off the bobbin 17A and begins drawing it off the bobbin 17B. Prior to receipt of the signal by the control device, the selection of the weft yarns 2, 3, 4 had been implemented by the individual feed devices 5, 6 and 7 by appropriately and alternatingly driving the presentation fingers 38, 39, 40. After receipt of the signal from the bobbin changeover detector 23, the weft yarn 2 is precluded from weft insertion by controlling the insertion selection means 14 to employ the fingers 38, 39 to select only from the weft yarns 3 and 4. Even though no longer participating in the weft insertion into the shed 8, weft yarn 2 remains joined to the fabric and is drawn off further. Once the quality defect, for instance the knot 41 in the weft yarn 2, has reached a position from which it can no longer be inserted into the shed 8, the weft yarn selection means 14 is switched to normal operation, and weft yarn 2 can once again participate in weft insertion.

In the situation shown in FIG. 3, the defect (knot 41), which was originally in one of the positions shown in FIG. 1, has been shunted beyond the region of the insertion scissors 10. In a first version of the illustrated embodiment, the switching of the selection means 14 to normal operation at this time is controlled by a circuit 42, which previously received a signal from the control unit 37 indicating a quality defect (knot or irregularity) and now, at some time interval after receiving the signal itself, emits another signal to switch over the selection means 14. The time interval following receipt of the initial defect signal at which normal operation resumes is determined by the time required by the weft yarn to move from the bobbin 17B into the region of the insertion scissors 10, i.e., by the time needed for the fabric lateral edge or the waste strip 33 to carry along a weft of the appropriate length. This time interval depends on the weaving density and on the rate at which the fabric is being produced. Obviously, counting of the time must be interrupted when the loom is intermittently stopped.

In another version of the illustrated embodiment, circuit 42 counts the number of filling insertions following defect detection and thereupon appropriately emits a signal to switch over the selection means 14. The number of insertions also is determined by the weaving density and the rate of fabric production.

In a variation of the illustrated embodiment, the yarn presentation needles 38, 39 and 40 of the yarn-presentation device 13, the yarn stop-motion means 16, or the exit yarn guides 48, 49, 50 of the accumulators 20, 21, 22 may be fitted with detectors for sensing the nearby motion of a defect (knot or other irregularity) and relaying this information to the control unit 37. This signal is then transmitted to the circuit 42 which, after a given time interval or following a specific number of further insertions, emits a signal to the control unit 37 that the selection means 14 can be switched back to normal operation because the defect has passed the insertion scissors 10. The time at which the portion of the weft with the defect has passed the insertion scissors 10 can be predetermined with high reliability and, therefore, these two detection procedures may be used to accurately determine the time or the number of weft insertions which is sufficient to shunt the defective portion of the weft past the point of insertion, based on which the time interval during which a weft yarn is precluded from insertion can be set.

Figure 4:
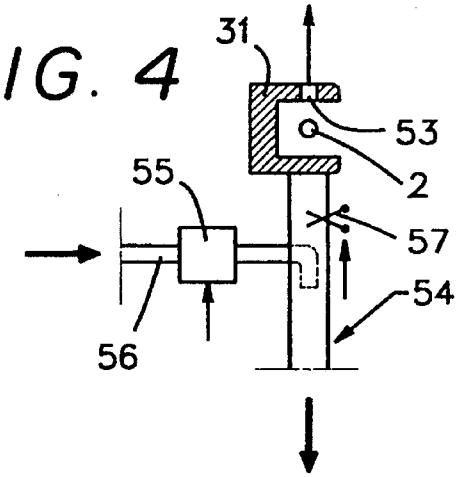
FIG. 4 is a detail of a variation of the gripper loom of FIG. 2.

A further variation of the preferred embodiment is shown in FIGS. 1 and 4, in which an illustrative optical detector 53 is present in the vicinity of the guide 31. A signal is sent to the control unit 37 when the portion of the weft yarn which is defective passes detector 53, detector 53 being mounted downstream, relative to movement of the defective weft, of the insertion scissors 10 so that the signal from detector 53 can be used to immediately switch the selection means 14 back to normal operation.

The waste strip 33 is pulled off by means of a system (not shown) which winds the waste strip 33 and sucks it into a pneumatic suction apparatus for transfer to a waste container. This suction apparatus may also be used to draw a defective weft yarn (weft yarn 2 in the illustrated situation) from the feed devices (feed device 5 in the illustrated situation), in particular by increasing the suction of the suction apparatus after the defective portion of the weft yarn, which initially moves along with the waste strip 33, has reached the suction apparatus. It is possible thereby to shunt more rapidly the defective portion of a weft yarn past the point of insertion, and thus to shorten the time during which it does not participate in weft yarn insertion.

As shown in FIG. 4, another preferred embodiment includes a suction apparatus 54 in the vicinity of the yarn guide 31 to remove as quickly as possible a weft yarn discovered to be defective from the running guide devices. The suction apparatus 54 is fitted with a pressurization conduit 56 which includes a switchable valve 55 to form a suction jet pump and is driven by the control unit 37. Once the control unit detector 53 indicates that a weft yarn has reached the vicinity of the guide 31 and hence is in the vicinity of the suction apparatus 54, the valve 55 is opened to turn the suction apparatus 54 on. Initially, the suction apparatus 54 operates at comparatively high suction to assure that the defective weft yarn (weft yarn 2 in the illustration) is pulled off of the accumulator 20. Once the defect (knot 41) has been detected by the detector 53, a second signal is transmitted to the control unit 37 which thereupon switches the valve 55 to reduce suction in the suction apparatus 54. This suction is such that the weft yarn is retained but no longer drawn off the accumulator. At the same time, the selection means 14 are switched back to normal operation so that the previously defective weft yarn is now again included in the weft insertion. Next, the gripper 15 takes hold of the weft yarn guided in the guide 31 (weft yarn 2 in the illustration) and inserts it into the shed where it will be severed by the insertion scissors 10. It should be noted that a scissors 57 belonging to the suction apparatus 54 and driven by the control unit 37 also may very easily be used, as shown in FIG. 4.

If a weft quality defect is noted during weaving and thereupon the selection means 14 only allows selection from among the weft yarns of the remaining feed devices weft yarns 3 and 4 of the feed devices 6 and 7, then a yarn may rupture in one of the feed devices and thereupon will be detected by the yarn stop motion means 16. In such an event, the control 37 unit may dictate that only the weft yarn 4 of the feed devices 7 is selected for weft insertion, as a result of which weaving may proceed at the same rate of weaving and with the same weaving output.

In case the loom is to be shut down following yarn rupture in one or more of the feed devices, the weaving operator may of course also manually remove the quality defect (knot or other irregularities) when repairing the yarn breaks. Input device 43 is provided to allow the operator in that situation to input a command which ensures the automatic removal of the particular weft yarn be terminated and also ensures that the selection means 14 is then switched back to normal operation so that the weft yarns to be inserted can again be selected from all feed devices 5, 6, 7.

As a rule, a yarn rupture can be remedied by ways other than knotting the ends, such as by substituting a wholly new weft yarn, or by splicing the two parts of the weft yarn. If the yarn rupture is to be repaired by knotting, a keypad 44 may be provided to allow the weaving operator to feed a quality defect signal into the control unit 37, as a result of which the described procedure for the knotted and hence defective weft yarn can be carried out when starting the loom.

Moreover, it is easily possible to so design the control unit 37 that the weft yarns are monitored for defects only as needed, i.e., when knots and other irregularities must be absent from the fabric. Turning on or off this monitoring of quality defects may take place for instance at the input unit 43. The control unit 37 in addition may include a recording unit recording and counting the number of defects (knots or other irregularities) that were removed, and, where called for, display the recording.

The invention preferably applies to looms with three or more feed devices 5, 6, 7 so that weaving may proceed even if several of the feed devices were to incur a quality defect or yarn rupture.

As regards the illustrative embodiment of FIG. 1, the accumulator units 20, 21, 22 may be fitted with turn detectors 45, 46, 47 for sensing at least approximately the number of turns present on the accumulator units 20, 21, 22. This allows the minimum and maximum amounts of weft yarn on an accumulator to be determined. By using the minimum weft yarn amount, the control unit 37 can ascertain how many weft insertions may take place from the particular feed device 5, 6 or 7 at which a defect was found before the defect is incorporated into the fabric and thereby reduce yarn wastage by allowing normal operation to proceed for several insertions following detection of the defect while still precluding the defect from being incorporated into the fabric.

For example, if turn detector 45 counts at least ten turns and at most fourteen turns on the accumulator 20, and if four turns are required for one insertion, then two more weft insertions may take place at the shed without introducing the defect into the fabric. In such a case, the control unit 37 will transmit a signal to the selection means 14 allowing two insertions to be taken off the particular feed device 5 for weft yarn 2 before the selection means 14 no longer allows this feed device 5 to be selected. As a result, the time interval during which the affected feed device (feed device 5 in the illustrated situation) does not participate in weft insertion can be minimized.

Moreover, using the above-described determination of the maximum amount of weft yarn on the accumulator, a determination can also be made of the minimum time interval during which the weft must remain joined to the junction site 9. In the illustrated embodiment, this is the time interval required by a particular weft yarn to move, along with the fabric edge, through a length of at least six turns, plus the distance between the bobbin 17*b* and the junction site 9 of the fabric edge.

Those skilled in the art will appreciate that the invention also applies to looms which weave with several different types of weft yarns. If, for instance, two types of weft yarns are being woven, then one feed mechanism might include three feed devices for the first type of weft yarn and three feed devices for the second type of weft yarn, the feed mechanisms alternatingly supplying one weft yarn to the insertion devices. If a defect, such as a knot or other irregularity, is detected in one of the first type of weft yarn feed devices then the weft yarn insertion will take place only from the remaining feed devices for this feed mechanism.

Having thus described in detail several preferred embodiments of the invention, those skilled in the art will nevertheless appreciate that the method and the equipment of the invention are not restricted to the above-described embodiments, but also may assume other forms and dimensions, and therefore should be limited only by the appended claims.

I claim:

1. A method of controlling a weft yarn feeding mechanism, the feed mechanism including a control unit; means for alternately feeding at least two weft yarns, each weft yarn being fed by its own feed device, with each feed device including a yarn supply; and means for selecting a weft yarn to be inserted into a weaving shed to form a fabric, comprising the steps of:

monitoring the weft yarns for quality defects in the region between the yarn supplies and the fabric;

generating a defect-indicating signal based on said monitoring when a defect is detected;

transmitting the signal to said control unit;

causing the selection means to exclude the weft yarn with the defect from its selection operation; and after detection of the defect, continuing to move the weft yarn containing the defect through said selection means until the defect has reached a predetermined position downstream of said selection means at which insertion of a non-defective portion of the weft yarn containing the defect will not cause the defect to be inserted within the shed.

2. A method as claimed in claim 1, wherein the step of moving the defective portion of the weft yarn comprises the step of causing the defective portion of the weft yarn to remain joined to the fabric and be shunted beyond its feed device by an advance of the fabric until the defective portion of the weft yarn has reached a vicinity of the fabric.

3. A method as claimed in claim 1, wherein the step of moving the defective portion of the weft yarn comprises the step of using a moving device to move the defective portion of the weft yarn past the point in which it would be inserted into the shed.

4. A method as claimed in claim 1, wherein the feed devices each comprise an accumulator, and further comprising the step of monitoring a number of turns of weft yarn present on the accumulator to determine a minimum amount of said weft yarn present on the accumulator and thereby ascertain how many weft insertions of said weft yarn present on the accumulator may take place before a defect detected in said weft yarn present on the accumulator will be incorporated into the fabric.

5. A method as claimed in claim 1, wherein the step of monitoring the weft yarn for defects comprises the step of monitoring a changeover between two bobbins of a feed device.

6. A method as claimed in claim 1, wherein the step of monitoring the weft yarn for defects comprises the step of monitoring a thickness of the weft yarn.

7. A method as claimed in claim 1, further comprising the step of excluding the weft yarn containing the defect from selection until a predetermined time after transmitting the defect-indicating signal to the control unit.

8. A method as claimed in claim 1, further comprising the step of resuming selection of the weft yarn containing the defect following a predetermined number of insertions after transmitting the defect-indicating signal to the control unit.

9. A method as claimed in claim 1, further comprising the step of also monitoring the weft yarn for quality defects in a vicinity of the fabric at a point downstream of a zone of weft insertion, and excluding the weft yarn containing the defect from selection until the defect has been detected at the point past the zone of insertion.

10. A method as claimed in claim 1, wherein the feed devices each comprise an accumulator, and further comprising the step of counting a number of turns on the accumulator and delaying the step of excluding the weft yarn with the defect from selection until after unwinding a predetermined number of turns, wherein the predetermined number of turns is the number of turns which will be wound off the accumulator before a detected defect reaches the zone of insertion.

11. A weft yarn feeding mechanism for alternately supplying at least two weft yarns to be inserted into a weaving shed to form a fabric, each weft yarn being fed by its own feed device and each feed device comprising a yarn supply, and means for selecting a weft yarn to be inserted into the fabric, comprising:

means including at least one detector for each feed device for monitoring a respective weft yarn for quality defects, and generating a defect signal based thereon, said detector being mounted between the yarn supply and the fabric and connected to a control unit, the control unit including means for receiving the defect signal; and means for preventing the selection means from selecting a weft yarn for weft insertion until a portion of the weft yarn which includes a defect has been shunted through the selection means into a predetermined region downstream of the selection means from where the defect will not be inserted into the shed when a non-defective portion of the weft yarn containing the defect is inserted into the fabric.

12. A mechanism as claimed in claim 11, wherein the detector is mounted in a region of the yarn supply between two supply bobbins and is adapted to emit a signal indicating a changeover from one supply bobbin to the other.

13. A mechanism as claimed in claim 11, wherein each feed device includes an accumulator and the detector is positioned between the yarn supply and the accumulator.

14. A mechanism as claimed in claim 13, further comprising a turn detector for sensing the turns of weft yarn wound onto the accumulator in order to determine whether the portion of the weft yarn which has a defect has moved past the area where it might be inserted into the shed according to the number of turns on the accumulator.

15. A mechanism as claimed in claim 11, wherein the control unit includes a timer means for re-enabling selection of a weft yarn with a quality defect by taking into account the time interval following a defect indicating signal.

16. A mechanism as claimed in claim 11, wherein the control unit includes a counter means for re-enabling selection of a weft yarn with a quality defect, by taking into account a number of weft yarn insertions following a defect-indicating signal.

17. A mechanism as claimed in claim 11, wherein a second yarn defect detector is connected to the control unit and is mounted in a path of the defective portion of the weft yarn past the zone at which it would have been inserted, the control unit including means for re-enabling selection of a weft yarn with a quality defect based on a signal from the second yarn defect detection.

18. A mechanism as claimed in claim 11, further comprising a suction system provided for removing a weft yarn, said system being mounted after the selection means and downstream from the weft insertion means.

* * * * *